United States Patent [19]

Maas et al.

[11] Patent Number: 4,575,298

[45] Date of Patent: Mar. 11, 1986

[54] APPARATUS FOR DESTACKING SHEETS OF MATERIAL

[75] Inventors: Curtis N. Maas, Chicago; Sastry K. Ganti, Wheeling, both of Ill.

[73] Assignee: Reichel & Drews, Inc., Itasca, Ill.

[21] Appl. No.: 454,271

[22] Filed: Dec. 29, 1982

[51] Int. Cl.[4] ..... B65H 03/08; B65H 05/06

[52] U.S. Cl. ..... 414/116; 271/97; 271/98; 271/124; 271/130; 414/118

[58] Field of Search ..... 271/42, 97, 98, 105, 271/128, 130, 124; 414/116, 117, 118, 119, 121

[56] References Cited

U.S. PATENT DOCUMENTS

| | | | |
|---|---|---|---|
| 1,639,221 | 8/1927 | Fairchild et al. | 271/152 |
| 2,595,015 | 4/1952 | Sparks | 187/17 |
| 2,917,205 | 12/1959 | Matasic | 221/210 |
| 3,174,633 | 3/1965 | Stevens | 414/114 |
| 3,195,740 | 7/1965 | Lange et al. | 414/112 |
| 3,402,928 | 9/1968 | Redding | 271/155 |
| 3,448,978 | 6/1969 | Gibson | 271/11 |
| 3,770,266 | 11/1973 | Wehr et al. | 271/109 X |
| 3,902,713 | 9/1975 | Von Luhmann et al. | 271/154 |
| 3,966,190 | 6/1976 | Grant | 271/42 |
| 4,052,051 | 10/1977 | Mersereau et al. | 271/94 |
| 4,119,219 | 10/1978 | Marschke | 414/114 |
| 4,206,912 | 6/1980 | Pearson | 271/154 |
| 4,231,565 | 11/1980 | Ichikawa et al. | 271/105 |
| 4,235,432 | 11/1980 | Marschke | 271/124 X |
| 4,306,684 | 12/1981 | Peterson | 271/105 |
| 4,364,550 | 12/1982 | Hynes | 271/112 X |

FOREIGN PATENT DOCUMENTS

| | | | |
|---|---|---|---|
| 2461448 | 3/1981 | France | 271/98 |
| 89139 | 7/1980 | Japan | 271/42 |
| 278619 | 11/1970 | U.S.S.R. | 271/128 |

*Primary Examiner*—Robert J. Spar
*Assistant Examiner*—Janice Krizek
*Attorney, Agent, or Firm*—Dressler, Goldsmith, Shore, Sutker & Milnamow

[57] ABSTRACT

An apparatus for unstacking or destacking sheets of material from a stack of such sheets is disclosed. The apparatus includes an arrangement for directing air against the stack of sheets in order to entirely separate at least one uppermost sheet of the stack from the remaining sheets by floating that sheet on a layer of air. A pusher mechanism is provided for moving the separated sheet out of registry with the remaining sheets, and into a roller mechanism which displaces the separated sheet from above the remaining sheets of the stack. The apparatus also includes an indexing mechanism for indexing the stack of sheets upwardly in order to float the next sheet of the stack and present it to the pusher mechanism. A sensing mechanism is provided for determinig the position of the uppermost one of the remaining sheets of the stack as the stack is indexed upwardly. Notably, the apparatus can be used for destacking sheets of a wide variety of materials, and is operable at a relatively high speed with minimal scratching, marrying, or other damage to the sheets.

9 Claims, 13 Drawing Figures

12
10
102
104
96
80
112
86
244
84
68
62
66
90
246
78
70
44
72
64
S
60
74
30
76
18
20
43
14
28
50
16
19
54
54
32
48
52
46
52
34
12
36
40
42
38

7.
8.
8.
7.
60
62
66
66
90
90
96
96
102
110
110
112
112
112
114
114
120
122
124
125
126
126
127
127
128
129
130
132
134
134
136
138
140
142
152
152
154
154
156
156
158
160
160
162
164
166
168
170
170
172
174
176
176
176
176
178
180
192
204
204
206
208
210
212
214
216
218
220
222
226
228
230
240
242

APPARATUS FOR DESTACKING SHEETS OF MATERIAL

TECHNICAL FIELD

The present invention relates generally to arrangements for handling sheets of material, and more particularly to an improved apparatus and method for sequentially destacking sheets of material from the top of a stack of such sheets.

BACKGROUND OF THE INVENTION

During many manufacturing operations, it is necessary that single sheets of material be removed from a stack of such sheets for subsequent processing or manufacturing operations. Such sequential unstacking or destacking of the sheets is frequently necessary during operations involving floor tiles, steel sheets, mirrored or ceramic tiles, cardboard or plastic sheets, and the like. For example, it is typically necessary during the manufacture of floor tile to remove partially finished tiles one at a time from a stack for subsequent application of adhesive backing, high-gloss plastic coating, or like finishing materials.

While it is usually desirable to provide a system which destacks sheets of material as quickly as possible, a major concern is avoiding scratching, marring, or other damage to the sheets, either by contact with each other or with the handling apparatus. This latter concern is particularly important in the destacking of materials such as floor or ceramic tiles since one surface of the sheet is generally exposed to view, and damage to that surface can prevent the tile from meeting the required standard of quality. Similarly, mirrored tiles require careful handling to avoid damage to their silvered surfaces.

Various arrangements have previously been employed for performing the destacking function. For example, some apparatus include roller or reciprocating plate mechanisms for sliding either the uppermost or lowermost sheet of material from the stack. As will be appreciated, however, such devices may result in high rates of rejection since the sliding contact of one sheet against another frequently damages the sheets. Other arrangements have employed movable suction devices such as for picking up the top sheet of a stack and moving it therefrom. However, these arrangements are frequently overly complex in design, and can be undesirably slow in their operation. Still other arrangements, such as for destacking of ferrous sheets of material, have employed magnetic devices for removing sheets from a stack. Obviously, such arrangements are completely unsuitable for use with non-ferrous materials, and are typically incapable of operating at desirably high speed.

In view of the shortcomings of heretofore known arrangements for destacking or unstacking sheets of material from a stack, it is desirable to provide an apparatus for destacking sheets of material which is operable at relatively high rates of speed, and which minimizes problems of marring or other damage to the sheets as they are handled. It is particularly desirable that such an apparatus be readily adaptable for handling sheets of various thicknesses, as well as for handling sheets of different materials, including vinyl and other plastics, wood, metal, glass, ceramics and cardboard.

SUMMARY OF THE INVENTION

In accordance with the present invention, a novel apparatus and method are disclosed for sequentially unstacking or destacking sheets of material from a stack of such sheets. Significantly, the present invention is readily adaptable for destacking sheets of almost any material, and is further adaptable for use with the sheets having a wide range of dimensions, including various thicknesses. These desirable results are accomplished by providing a system which entirely separates at least one uppermost sheet of the stack from the remaining sheets on a layer of air. This permits the separated sheet to be moved from above the remaining sheets with minimal marring or other damage, with an indexing mechanism provided to advance the stack upwardly so that the next sheet of the stack is floated on an air layer and then moved.

In the preferred embodiment of the invention, a vertically movable platform is provided for supporting the stack of sheets, with a preferably hydraulically operated indexing mechanism provided for incrementally advancing the platform and the stack upwardly as the sheets are removed from the top of the stack. The apparatus further preferably includes a pair of air plenums which are arranged to direct air against the opposite, lateral sides of the stack so as to cause the uppermost sheet of the stack to be entirely separated from and floated above the remaining sheets of the stack on a layer of air.

The apparatus includes an arrangement for moving the separated sheet out of registry with and from above the remaining sheets of the stack. This includes a cyclically operable sheet pusher mechanism for initially pushing the separated sheet out of registry with the remaining sheets of the stack by engagement of the pusher mechanism with the marginal edge portion of the separated sheet. As will be appreciated, sliding contacts between the sheets is essentially avoided by floating the uppermost sheet before it is moved by the pusher mechanism.

In order to subsequently displace the separated sheet from above the remaining sheets of the stack, a pinch roller mechanism is preferably provided so as to receive the separated sheet after it is moved by the pusher mechanism. Since there is no relative motion between the engaging surfaces of the rollers and the sheet moved therebetween, damage to the sheets is further minimized.

In order to present the next sheet of the stack to the pusher mechanism, automatic controls are provided for indexing the stack upwardly by elevation of the stack-supporting platform. The control arrangement includes a stack-height sensing mechanism including a cyclically operable movable foot pad and sensor probe adapted to sense the position of the uppermost sheet of the stack. This is a particularly important feature of the present invention, since proper positioning of the uppermost one of the remaining sheets of the stack is necessary to assure proper presentation of the next sheet to the pusher mechanism, even though each sheet may be relatively thin. Additionally, some variations in the exact thicknesses of the sheets of the stack is common because of manufacturing tolerances.

Because of the variations in sheet thickness which result from normal tolerances, elevation of the stack-supporting platform a fixed amount during each cycle of the machine could easily result in malfunction. Instead, the automatic controls of the present invention elevate the platform and the stack until the uppermost sheet reaches a predetermined location. Because air is continually directed against the stack by the air plenums of the apparatus, the sensing mechanism preferably is arranged to sense the position of the uppermost sheet of the stack before it is completely floating on the layer of air. To this end, the cyclically operable movable foot pad of the apparatus operates in timed relation to the pusher mechanism to positively engage the top sheet of the stack before the indexing mechanism is operated to move the stack upwardly. During indexing, the foot pad maintains the uppermost sheet at least partially in contact with the sheet beneath it.

The movable foot pad assembly carries the sensor probe so that the position of the uppermost sheet of the stack is sensed or determined before that sheet is entirely separated from the remaining sheets of the stack by the air flow being directed against the stack by the air plenums. In this manner, the position of the stack is sensed while it is "solid" (i.e. the sheets of the stack are in contact with each other) as the stack of sheets is indexed upwardly. When the uppermost one of the sheets reaches the predetermined location for allowing for the proper air film thickness for presentation of the top sheet to the pusher mechanism, the sensing mechanism signals the control system to stop the upward movement of the stack. The movable foot pad (and sensor probe) are then moved upwardly to permit the top sheet of the stack to fully float by the action of the air plenums, and the pusher mechanism is operated to move the floated sheet out of registry with the remaining sheets of the stack. These steps are cyclically repeated so that each sheet of the stack is moved therefrom.

As previously noted, speed of operation is particularly important in order to provide a device which can be advantageously employed commercially. In this regard, the present apparatus operates to initiate upward indexing movement of the stack of sheets before the last-separated sheet of the stack is completely displaced from above the remaining sheets of the stack. To facilitate operation in this manner, a movable pressure plate is provided which limits the upward movement of the separated sheet. The pressure plate maintains the separated sheet in proper relation to the pusher mechanism until the pusher mechanism operates to feed the separated sheet into the pinch roller mechanism of the apparatus. The pressure plate is then moved upwardly as the stack of sheets is indexed upwardly. This helps to avoid interference between successive sheets of the stack as they are destacked, and avoids interference of the sheet being drawn through the pinch rollers with the pressure plate.

Other features of the present apparatus faciliate its high speed handling of the sheets by permitting a further stack of sheets to be readily received on the vertically movable platform. The apparatus preferably includes rollers adapted to project through the platform for permitting a stack of sheets to be rolled into the apparatus. The hydraulic arrangement for vertically moving the platform preferably includes controls for permitting the platform to be lowered and raised at speeds which are relatively greater than the rate of speed during upward indexing movement of the platform to facilitate rapid reloading with a new stack. Notably, the platform preferably includes means for directing air against the lower surface of the lowermost sheet of the stack. In this manner, the last sheet is properly presented to the pusher mechanism for advancement into the pinch rollers.

Numerous other features and advantages of the present invention will become apparent from the following detailed description and accompanying drawings.

DETAILED DESCRIPTION

Figure 1:
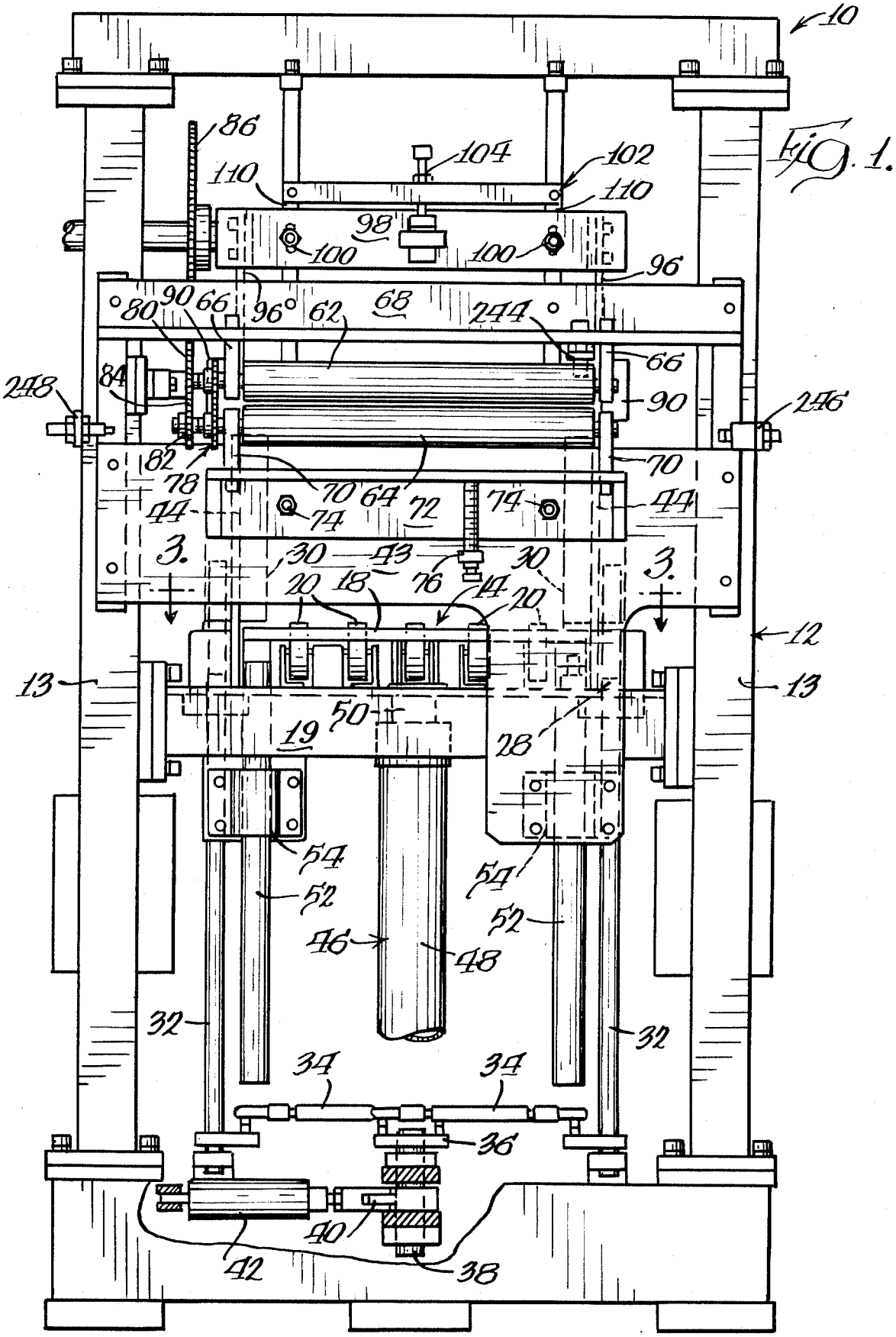
FIG. 1 is a front elevational view in partial cutaway illustrating the present destacker apparatus.

While the present invention is susceptible to embodiment in various forms, there is shown in the drawings and will hereinafter be described a presently preferred embodiment with the understanding that the present disclosure is to be considered as an exemplification of the principles of the invention and is not intended to limit the invention to the specific embodiment illustrated.

Figure 2:
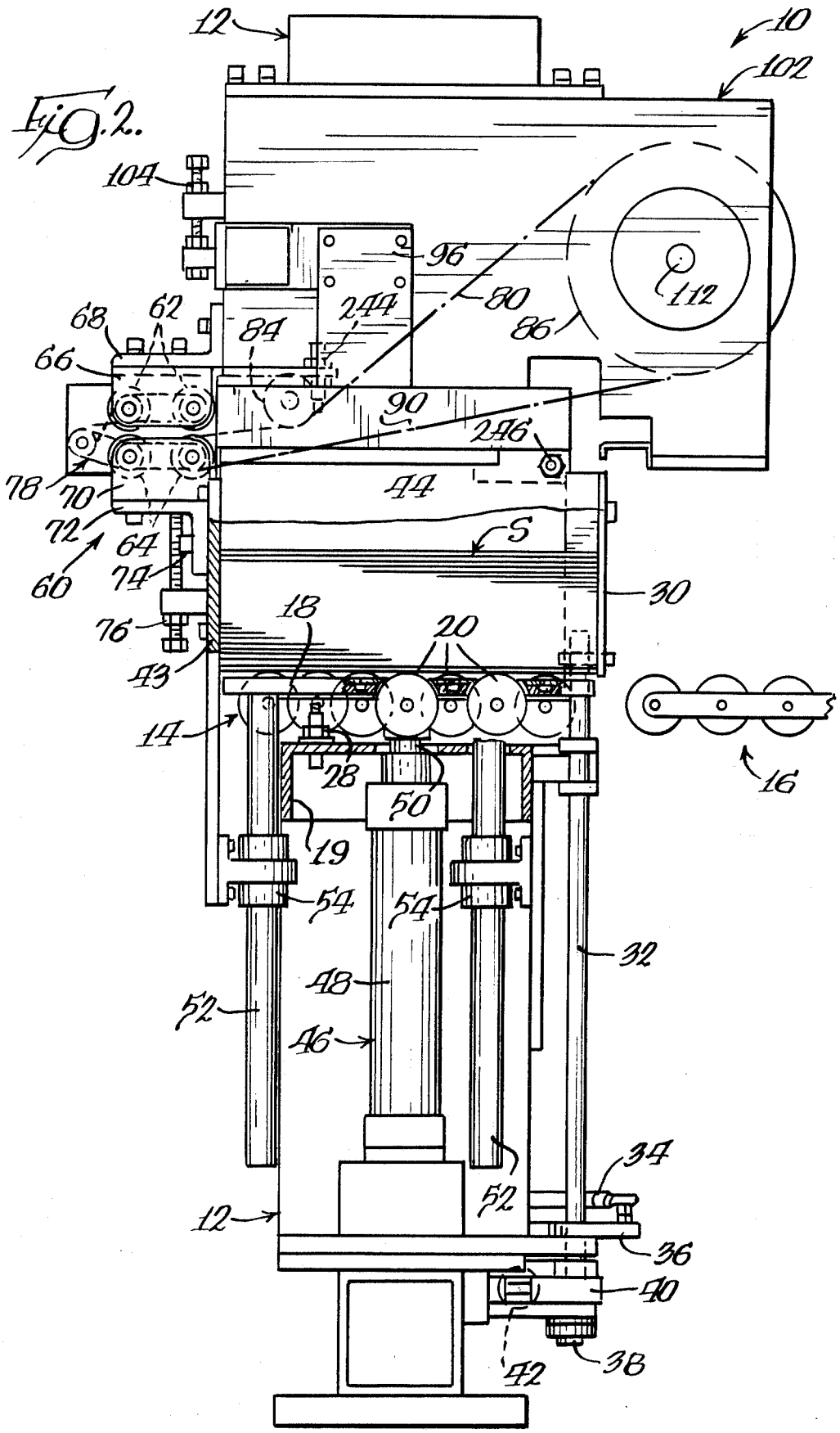
FIG. 2 is a side elevational view in partial cutaway of the destacker apparatus illustrated in FIG. 1.

Referring now to FIGS. 1 and 2, therein is illustrated the destacker apparatus 10 of the present invention for unstacking or destacking sheets of material from a stack of such sheets. For purposes of the present disclosure, the construction and operation of destacker 10 will be described with the desired result considered to be destacking of the sheets of material one at a time from a stack, designated S (FIG. 2). However, it will be appreciated that by appropriately adjusting the various operating mechanisms of the present apparatus, the device can be made to function so that more than one sheet of material is removed from stack S during each cycle of operation of the apparatus. For most operations where destacking of sheet material is necessary, unstacking of single sheets of material is typically required.

Destacker 10 includes a generally upstanding frame 12, including a pair of spaced apart generally vertically extending frame columns 13. The stack of sheet material S to be unstacked is received within destacker 10 upon a stack-supporting platform, generally designated 14. As illustrated in FIGS. 1 and 2, platform 14 is shown in its lowermost position. In this position, platform 14 is adapted to receive stack S of sheet material, such as from an associated roller conveyor 16 or the like. In a typical installation, stacks of sheet material are periodically and continuously received upon platform 14 for subsequent destacking of the sheets of the stack.

Figure 3:
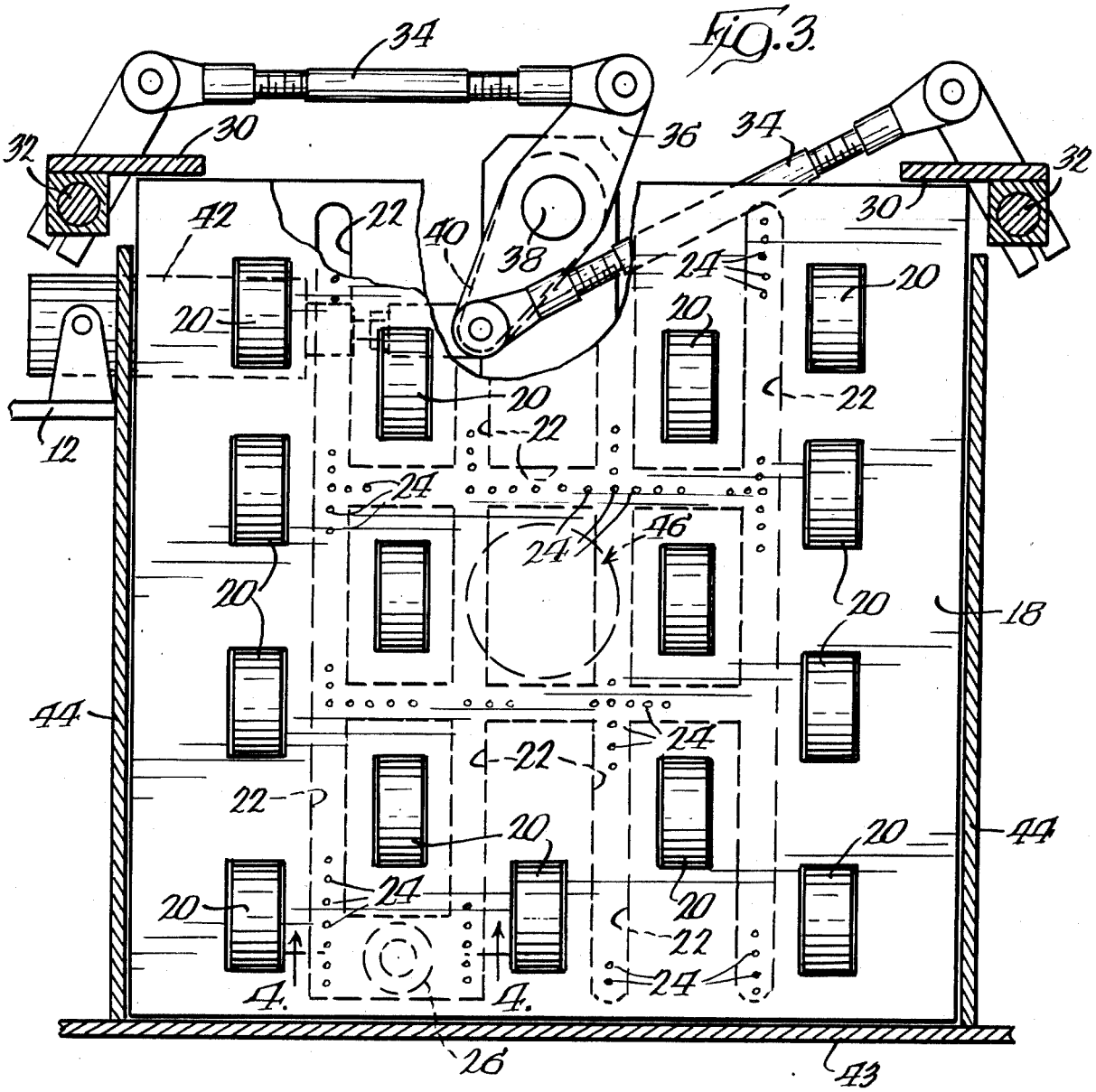
FIG. 3 is a view taken generally along lines 3—3 of FIG. 1 illustrating the construction of the stack-supporting platform of the present destacker apparatus.
Figure 4:
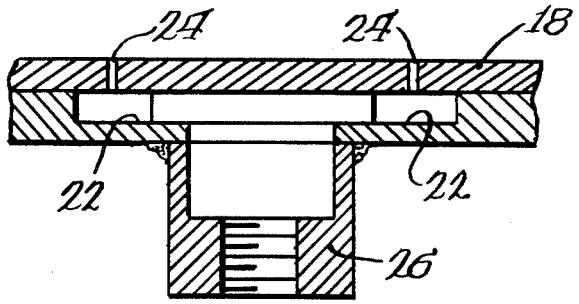
FIG. 4 is a cross-sectional view taken generally along lines 4—4 of FIG. 3 further illustrating the construction of the stack-supporting platform of the present apparatus.

As further illustrated in FIGS. 3 and 4, platform 14 includes a generally flat platform bed 18. Destacker 10 preferably includes a plurality of rollers 20 which are mounted for rotation on a frame member 19 which extends between columns 13. Rollers 20 are preferably vertically aligned with roller conveyor 16, and arranged to extend through platform 14 and project above bed 18 when the platform is in its lowermost position. In this manner, stacks of sheet material are smoothly and easily received on the rollers 20 with minimal marring or other damage. As the platform 14 is subsequently elevated, the stack is lifted from the rollers 20, and received and supported directly by platform bed 18.

As will be further described, sheets of material from the stack are removed from the top thereof after each sheet is separated from the stack on a layer of air. Because the layer of air upon which each sheet is floated is most efficiently formed between uniformly continuous flat surfaces, such as between adjacent sheets of the stack, the present apparatus preferably includes means for directing air against the lowermost sheet of the stack to assure that it is properly advanced out of the machine. This arrangement is preferred since the openings provided in platform bed 18 for rollers 20 impair the creation of the desired air layer beneath the lowermost sheet. Thus, as best shown in FIGS. 3 and 4, the platform bed 18 preferably defines a plurality of internal air passages 22 which extend within the platform between the openings for rollers 20. The platform bed further preferably defines a plurality of air openings 24 which open upwardly and communicate with the internal air passages 22. An air inlet 26 communicates with the air passages 22, and is connected with a suitable source of pressurized air (not shown) so that the lowermost sheet of the stack can be easily floated for ejection from the apparatus when it becomes the only remaining sheet of the stack. In order to signal the ejection of the last sheet of the stack, a photo-electric eye 28 is preferably provided on frame 12 for signalling the automatic controls of the apparatus when the lowermost sheet of the stack has been moved from above the platform 14. The sequence of operation will be further described hereinafter.

In order to assure that the stack of sheet material received from roller conveyor 16 is properly positioned on rollers 20 above platform 14, destacker 10 preferably includes a gate mechanism which moves from an opened to a closed condition as the stack of sheets is received on rollers 20. The gate mechanism preferably includes a pair of generally vertically extending gates 30 which are movable generally toward each other about respective vertical axes. In the illustrated embodiment, each gate 30 is supported upon its own vertically extending gate pivot shaft 32. The pivot shafts 32 are rotated in opposite directions by a pair of gate linkages 34 for opening and closing gates 30. Each linkage 34 is connected to a respective crank arm of a double crank arm 36 mounted on a shaft 38 for movement about a vertical axis. A crank arm 40 is connected to shaft 38, with rotation of shaft 38 effected through crank arm 40 by a suitable actuator 42. The preferred automatic controls of the destacker apparatus operate actuator 42 in timed relation to the other functions of the machine so that the gates open to permit a stack of sheet material to be received on rollers 20 above platform 14, with the actuator 42 then operated to effect closing of the gates behind the stack. Gates 30 are preferably arranged to contact the rearwardly disposed corners of the stack of sheets to assure that the stack is properly positioned. Correct positioning of the stack of sheets is further facilitated by the provision of a vertically extending front plate 43, and a pair of vertically extending side plates 44, with the plates 43 and 44 generally enclosing the stack of sheets when the stack is positioned on platform 14.

In accordance with the present invention, the stack of sheet material carried by the platform 14 is indexed upwardly as sheets of material are removed from the top of the stack. To this end, a preferably hydraulic indexing actuator 46 is provided for elevating the platform 14 and the stack of sheets carried thereby. Hydraulic actuator 46 includes a generally vertically oriented hydraulic cylinder 48 within which is vertically movable a hydraulic piston 50, with the vertical movement of piston 50 being imparted to the stack-supporting platform 14. In order to assure the stability of platform 14 as it is moved by actuator 46, a plurality of platform guide rods 52 (four being illustrated) preferably extend downwardly from the platform. Each guide rod 52 is respectively guided by a suitable guide bushing or bearing 54 mounted on frame 12 of the apparatus. This preferred construction assures that platform 14 remains level as it is moved by hydraulic actuator 46.

It should be noted that in the preferred form of the present apparatus, a dual mode system is provided for automatic operation of hydraulic actuator 46. Such an arrangement is preferred so that the actuator 46 is operable at distinct rates. During operation of the apparatus for destacking of sheets from the stack, actuator 46 is operated at a relatively slow rate during which relatively precise control is desirable. In contrast, the actuator is preferably operable at relatively greater rates when it becomes necessary to replenish the apparatus with a new stack of sheets. To this end, the arrangement for supplying pressurized hydraulic fluid to actuator 46 preferably includes dual fluid supply circuits including both a high speed circuit and a low speed, indexing circuit. The indexing circuit preferably includes a so-called micrometer flow control and a zero leakage sheer plate directional valve arranged in series. The fluid supply circuits are preferably electrically operated by the automatic controls of the apparatus, with the indexing circuit permitting precise control of the elevation of platform 14 and the stack of sheets by the actuator 46 during destacking.

As will be further described, the automatic controls of the apparatus include suitable detectors for determining when the last sheet of a stack has been ejected from the apparatus, at which time it is desirable to lower the platform 14 at a rate which is relatively greater than its upward indexing speed. Similarly, once a new stack of sheets is received upon platform 14, it is desirable that actuator 46 again be operated at a relatively high rate (as compared with its indexing speed) so that the uppermost sheet of the new stack is presented to the mechanisms which sequentially move the sheets of material from the top of the stack. In this manner, the apparatus can be reloaded with a new stack of sheet material in a minimum amount of time, thereby desirably enhancing the overall efficiency of the apparatus.

With further reference to the drawings, destacker 10 preferably includes a pinch roller mechanism, generally designated 60, which receives each sheet of material as it is separated from the stack of sheets, and which ejects them from the apparatus. Roller mechanism 60 preferably includes a pair of spaced apart, transversely extending upper rollers 62, and a pair of spaced apart, transversely extending lower rollers 64 preferably arranged in respective opposed relation with the upper rollers 62. Upper rollers 62 are supported for rotation on a pair of roller supports 66, which in turn are supported on frame 12 of the apparatus by a transversely extending upper angle bracket 68. Similarly, lower rollers 64 are rotatably supported upon a pair of roller supports 70, which in turn are supported on front plate 43 of the apparatus by a transversely extending lower angle bracket 72. The use of roller mechanism 60 is preferred in that sheets of material removed from the stack can be displaced from above the remaining sheets of the stack with minimal marring or other damage to their expansive surfaces since there is essentially no relative movement between the sheets of material and the surfaces of the rollers 62 and 64. The provision of opposed pairs of upper and lower rollers is preferred in that sheets received within the roller mechanism are at least partially supported thereby when they are disposed between both pairs of the upper and lower rollers.

In order to accommodate ready adjustment of destacker 10 for handling of sheets of various thicknesses, means are preferably provided for adjusting the distance between upper rollers 62 and lower rollers 64. In the illustrated embodiment, this adjustment is provided by the releasable adjustable mountings 74 for lower angle bracket 72, with a roller adjustment mechanism 76 such as a lockable threaded shaft preferably provided for ready adjustment of the gap between the upper and lower rollers.

As will be appreciated, any number of arrangements can be provided for driving rollers 62 and 64 so long as rollers 62 rotate in the same direction, while rollers 64 rotate together in an opposite direction but at the same speed as rollers 62. In the illustrated embodiment, concurrent and opposite rotation of the upper and lower rollers 62 and 64 is provided by an arrangement including roller drive chain, generally designated 78 (FIG. 2), which operatively interconnects the upper and lower rollers 62 and 64. By this interconnection of the rollers, power supplied to any one of the rollers results in all the rollers rotating as intended. To this end, the apparatus includes a main roller drive chain 80 which is illustrated as connected to the inwardly disposed one of lower rollers 64 by a suitable roller drive sprocket 82. The main drive chain 80 extends from the roller drive sprocket 82 past a suitable chain-tensioning idler sprocket 84, and around a camshaft sprocket 86, which provide power for operation of other mechanisms in the destacker apparatus. Power for the apparatus can be provided by a suitable electric motor (not shown) which drives any of the sprockets associated with main drive chain 80, or which may include its own sprocket for driving the chain. Of course, other suitable drive arrangements can be provided in accordance with the teachings herein, with the arrangement illustrated having been found to be reliable, economical, and relatively compact.

In accordance with the present invention, at least one sheet of material from the stack S of sheets is separated from the remaining sheets of the stack and presented to the roller mechanism 60 for ejection from the apparatus. To this end, the preferred embodiment includes: (1) means for separating the uppermost sheet from the remaining sheets on a layer of air; (2) means for limiting the upward movement of the separated sheet; (3) means for pushing the separated sheet out of registry with the remaining sheets into the roller mechanism 60; and (4) means for detecting the position of the next uppermost sheet of the stack S to control the upward indexing of the stack by hydraulic actuator 46. These various mechanisms will now be described in detail.

Figure 5:
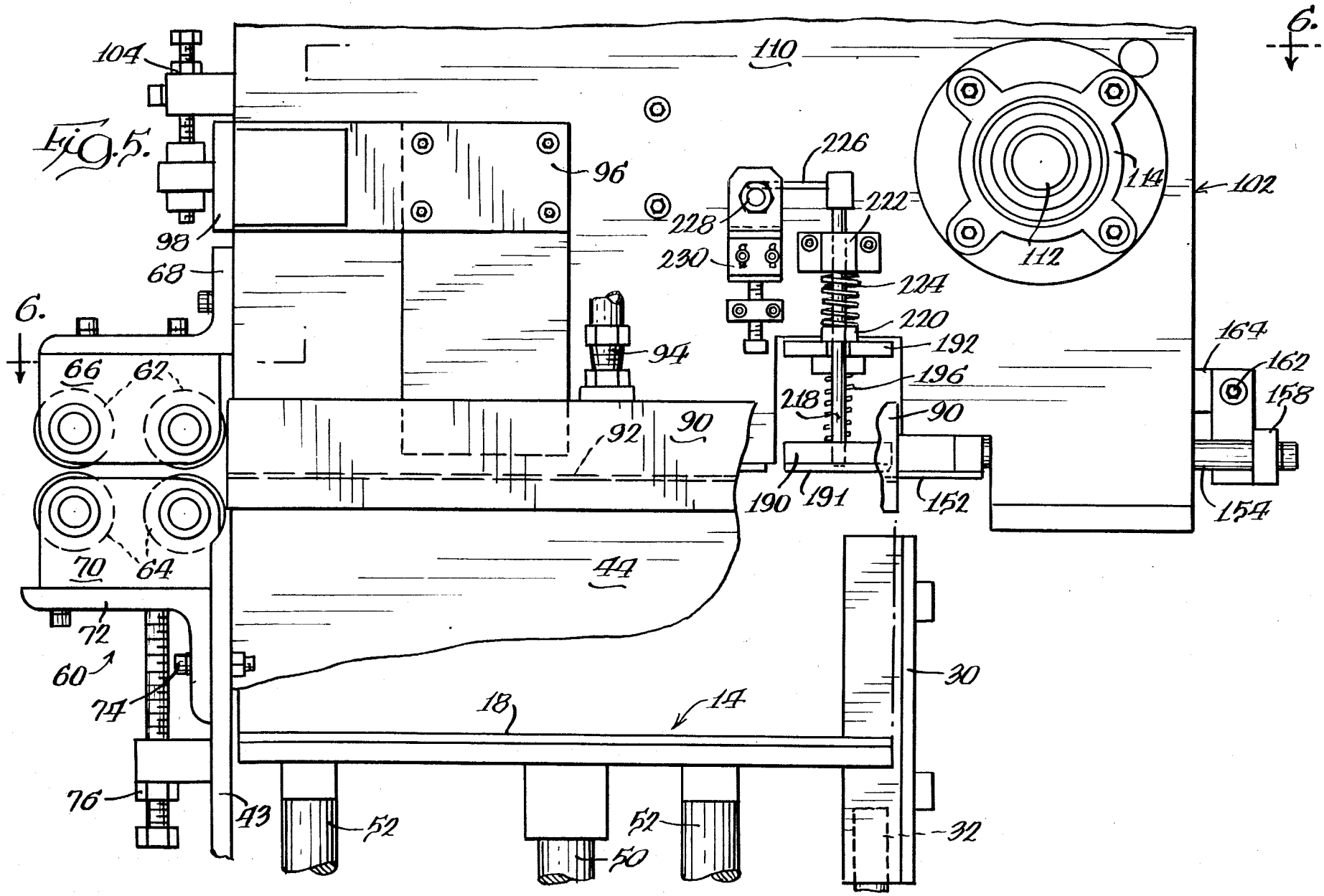
FIG. 5 is an enlarged, fragmentary side elevational view in partial cutaway illustrating the upper portion of the present destacker apparatus.
Figure 6:
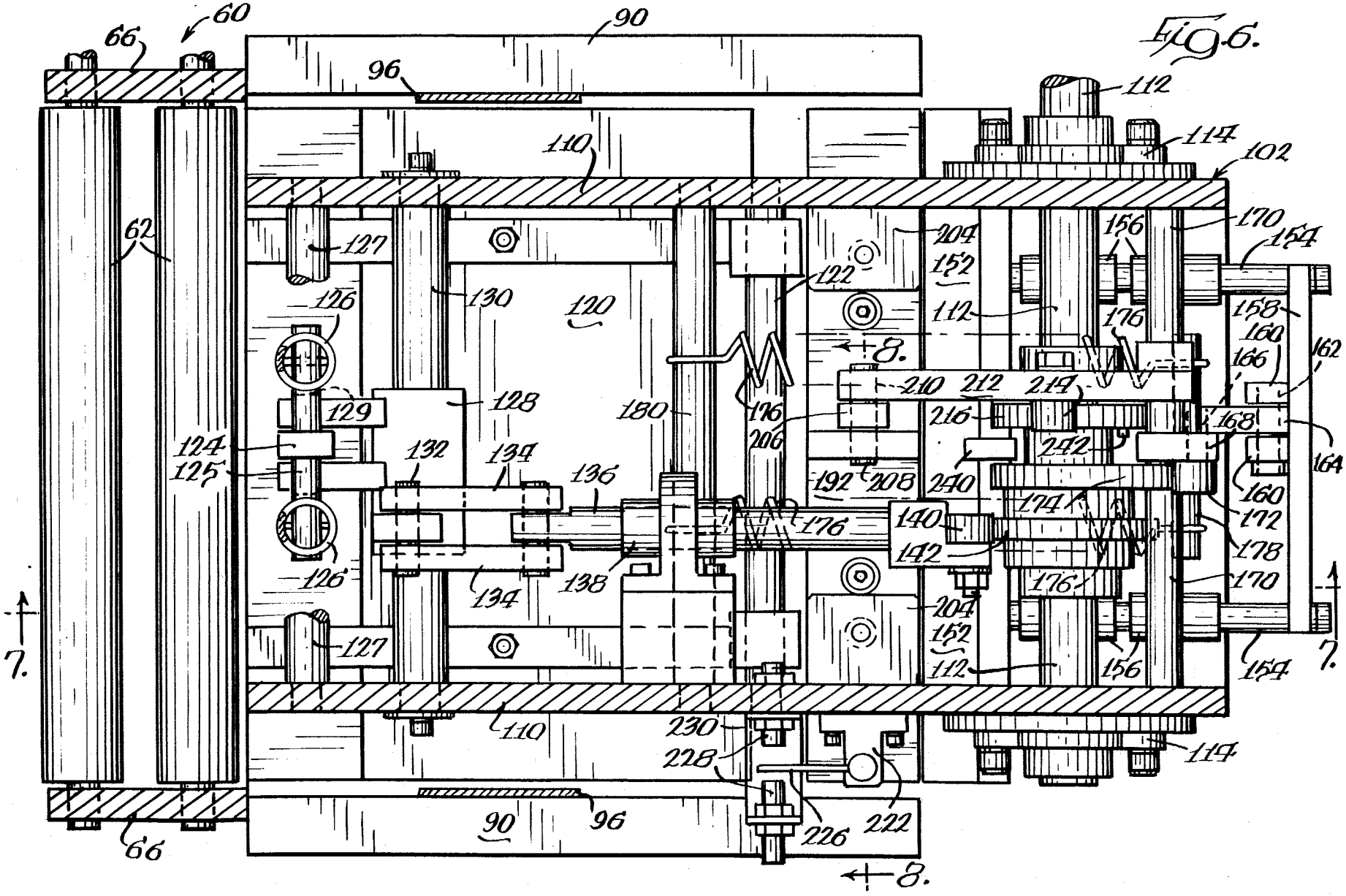
FIG. 6 is a cross-sectional view taken generally along lines 6—6 of FIG. 5.
Figure 8:
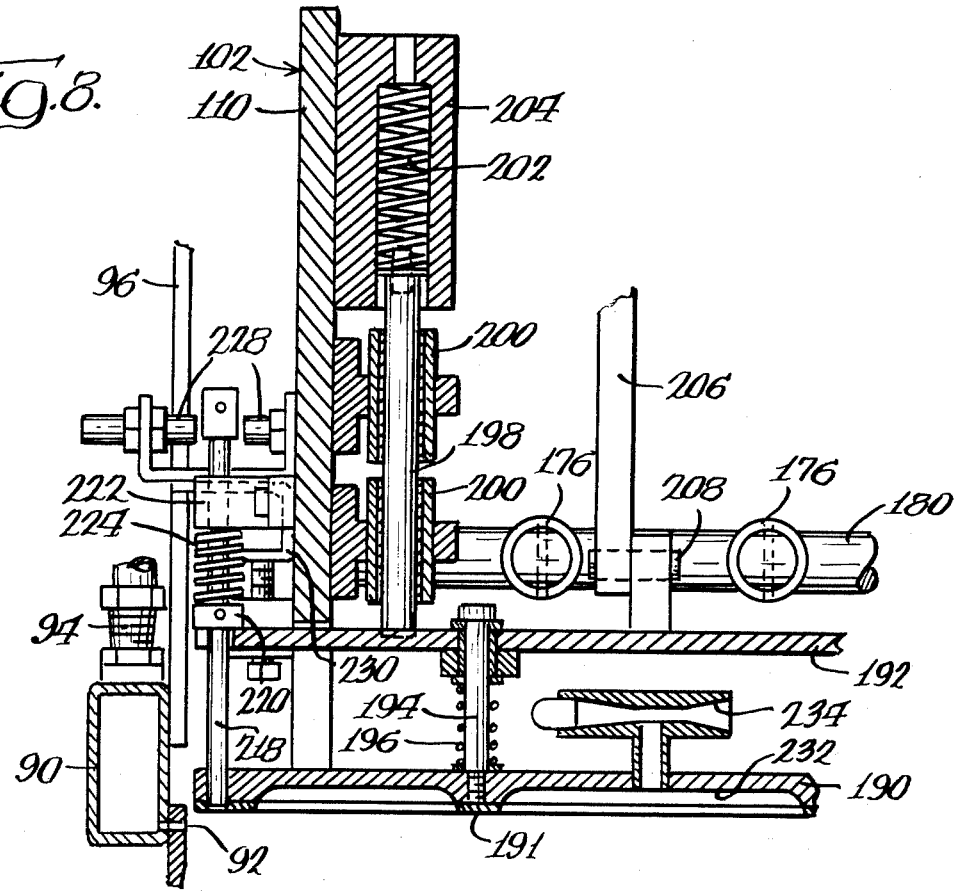
FIG. 8 is a fragmentary cross-sectional view taken generally along lines 8—8 of FIG. 6.

In order to entirely separate the uppermost sheet of the stack from the remaining sheets, and float that sheet on a layer of air, a pair of air plenums 90 are provided on respective opposite sides of the apparatus in close proximity to roller mechanism 60. As best illustrated in FIGS. 5, 6, and 8, each air plenum is preferably box-like in configuration, and defines a longitudinally extending slit-like air opening 92 through which pressurized air passes for direction or impingement against the lateral sides of the uppermost portion of the stack S of sheets. As will be appreciated, the exact arrangement for directing air against the stack of sheets can be varied in accordance with the teachings herein. For example, air nozzles or the like could be alternatively provided, and if appropriate, air-guiding vanes could be employed to guide and direct the airflow. Notably, the arrangement illustrated has proven economical to manufacture, while providing the preferred direction of a relatively thin flow of air along substantially the entire opposite lateral sides of the stack S of sheets.

Notabaly, air plenums 90 are preferably disposed in close proximity to the stack S of sheets when the stack is positioned for destacking. This desirably minimizes the required force of the air flow from the air plenums, and also desirably minimizes the turbulence of the air flow. As best shown in FIG. 3, front plate 43 and side plates 44 are preferably arranged to fit relatively closely to the stack S of sheets, this arrangement being preferred for further minimizing the turbulence and required force of the air flow directed against the stack by air plenums 90. As will be appreciated, the creation of a layer of air which entirely separates the uppermost sheet of the stack from the remaining sheets provides an almost frictionless bearing surface for the separated sheet for facilitating destacking, while avoiding sliding contact between the sheets which could mar or otherwise damage them.

In a typical application, the required air pressure within the air plenums 90 is on the order of several pounds per square inch or less, although the required air pressure and air flow will of course be dependent upon the dimensions and density of the sheets being destacked. The pressurized air to each air plenum 90 is delivered through an air inlet 94, which receives pressurized air from an associated source (not shown). As will be recognized, the nature in which sheets are separated from the stack by the air flow directed against the stack determines, to some extent, the range of thicknesses of the sheets that can be handled by the apparatus. Because in the usual application it is preferred to separate only the top sheet of the stack during each cycle of the machine, the minimum thickness of the sheets handled by the apparatus will usually be limited to a thickness which permits only the top sheet to be floated above the remaining sheets of the stack. In contrast, the maximum thickness of sheets which can be handled by the apparatus will generally be a function of the density of the material of the sheets. As will be apparent from the following description of related mechanisms of the apparatus, the maximum speed with which sheets can be destacked will usually be limited by the time required for establishing the layer of air between the uppermost sheet and the remaining sheets of the stack.

To permit the ready adaptability of the present apparatus for handling sheets of different thicknesses, the preferred embodiment includes an arrangement for adjustably supporting air plenums 90. This arrangement includes plenum supports 96 which are connected with the air plenums 90 and extend generally vertically therefrom. The plenum supports 96 are each connected to a transversely extending plenum adjustment plate 98. Adjustment plate 98 is preferably mounted by adjustable mountings 100 to a housing 102 which is suspended from the main frame 12 of the apparatus (FIG. 1). A plenum adjustment mechanism 104, including a lockable threaded shaft or the like, facilitates vertical adjustment of adjustment plate 98 relative to housing 102, thereby facilitating ready adjustment of the relative position of air plenums 90 for adjusting the apparatus for handling sheet materials of various thicknesses.

In the illustrated embodiment, the mechanisms for limiting the upward movement of the separated sheet of the stack, for pushing the separated sheet out of registry with the remaining sheets, and for sensing the position of the next uppermost sheet of the stack are each operated by cam-actuated linkages operated by a plurality of cams mounted on a common camshaft. To this end, housing 102 includes a pair of spaced, generally vertically extending housing side plates 110 which support a transversely extending camshaft 112 on camshaft bearings 114. The camshaft 112 has affixed thereto previously described camshaft sprocket 86, with power provided to camshaft 112 by power delivered to main drive chain 80, or by a suitable motor connected directly to the camshaft (with power then delivered to roller mechanism 60 by drive chain 80).

In order to limit the upward movement of the sheet separated from the remaining sheets of the stack by the layer of air, a generally rectangular pressure plate 120 is preferably provided. Because it is preferred during operation of the present apparatus to begin upward indexing of the stack of sheets before the separated one of the sheets is completely ejected from the apparatus by roller mechanism 60, pressure plate 120 is preferably movable to minimize interference between adjacent sheets as they are unstacked. To this end, pressure plate 120 is mounted for pivotal movement about a generally transverse, horizontal axis on a pivot shaft 122 which extends between housing side plates 110 (see FIGS. 6 and 7). A plate link 124 is pivotally connected to pressure plate 120 near its forward edge portion. A pin 125 extends transversely through the plate link 124, and is operatively connected with a pair of biasing tension coil springs 126 which impart upward pivotal movement to the pressure plate 120 during cyclic operation of the apparatus. Springs 126 extend generally vertically and are anchored to a spring anchor 127 which extends transversely between housing side plates 110.

Downward movement of pressure plate 120 in opposition to biasing springs 126 is provided through a cam-actuated linkage including a bell crank 128 having one of its crank arms pivotally connected with plate link 124 by pin 129. The bell crank 128 is pivotally supported on a transversely extending bell crank support 130 which is supported on housing side plates 110. The other crank arm of bell crank 130 is pivotally connected by pin 132 with a pair of links 134, which in turn are pivotally connected with a follower link 136. Follower link 136 is supported for linear, reciprocating movement by a slide bushing or other suitable linear bearing 138, which is mounted on one of the housing side plates 110. A roller follower 140 is mounted on the follower link 136, with the follower 140 adapted to engage the profile of a pressure plate cam 142 affixed to camshaft 112. Thus, during rotation of camshaft 112, pressure plate 120 is cyclically lowered and raised by pivotal movement about shaft 122.

In order to move the separated one of the sheets out of registry with the remaining sheets of the stack for ejection by roller mechanism 60, a pusher mechanism, generally designated 150, is provided. Notably, the pusher mechanism is preferably adapted to engage only the marginal edge portion of the sheets being unstacked by the apparatus while contact with the expansive surfaces of the sheets by the pusher mechanisms is avoided.

Pusher mechanism 150 includes a reciprocating transversely extending pusher plate 152 which engages the marginal edge portion of the sheet separated from the remaining sheets of the stack on the air layer. The pusher plate 152 is supported for linear reciprocating movement by a pair of transversely spaced pusher rods 154 each supported by a pair of slide bushings 156 or other suitable linear bearing arrangements. The pusher rods 154 are each connected with a transversely extending rod connector 158 which is operated by a spring-biased, cam-actuated linkage for imparting the intended reciprocating movement to the pusher plate 152. To this end, a pair of rod links 160 are affixed to the rod connector 158, with links 160 pivotally connected by a pin 162 with a link 164. The link 164 is in turn pivotally connected with a follower link 168 which is supported for pivotal movement on a support shaft 170 extending transversely between housing side plates 110. A cam roller follower 172 is mounted on follower link 168, and engages and follows the profile of a pusher cam 174 affixed to camshaft 112. A pair of biasing tension coil springs 176 are connected with follower link 168 by a spring pin 178, with the springs 176 extending forwardly from the follower link 168 to a spring anchor 180 extending between and affixed to housing side plates 110. In this manner, pushing movement of pusher plate 152 is imparted thereto by springs 176, with retraction of pusher plate 152 provided by the action of pusher cam 174 through the linkage. Notably, the rollers of roller mechanism 60 are preferably positioned as closely as possible to the stack of sheets being unstacked, thus permitting the stroke of pusher plate 152 to be desirably short. This facilitates high speed operation of the apparatus for improved efficiency over previous arrangements.

As previously noted, capability for high speed operation is a highly important feature of the present destacker apparatus. In this regard, operating efficiency is enhanced by indexing the stack-supporting platform 14 and the stack thereon upwardly as a sheet separated from the stack is displaced from above the remaining sheets by roller mechanism 60. However, the continued air flow directed against the stack of sheets by air plenums 90 can tend to separate the next uppermost sheet of the stack before that sheet is properly positioned for presentation to pusher mechanism 150. Additionally, normal variations in the thicknesses of the sheets of the stack resulting from ordinary manufacturing tolerances can further complicate correct presentation of the sheets to the pusher mechanism. Thus, the present apparatus includes a unique sensing mechanism for controlling the upward indexing movement of the platform 14 and the stack of sheets by hydraulic actuator 46. Rather than elevating the platform and stack a fixed amount during each cycle of the machine, the sensing mechanism detects the position of the next remaining sheet of the stack for controlling the indexing function. Because the next remaining sheet of the stack tends to be separated by the air flow from plenums 90 as the stack is indexed upwardly, the sensing mechanism uniquely functions to maintain at least a portion of the next sheet in contact with the remaining sheets so that the position of a "solid" stack is sensed. When the next sheet then reaches a predetermined location, the sensing mechanism is moved out of the way so that that sheet can be entirely separated from the remaining sheets by the air layer, and then moved out of registry with the remaining sheets by the pusher mechanism 150.

Figure 7:
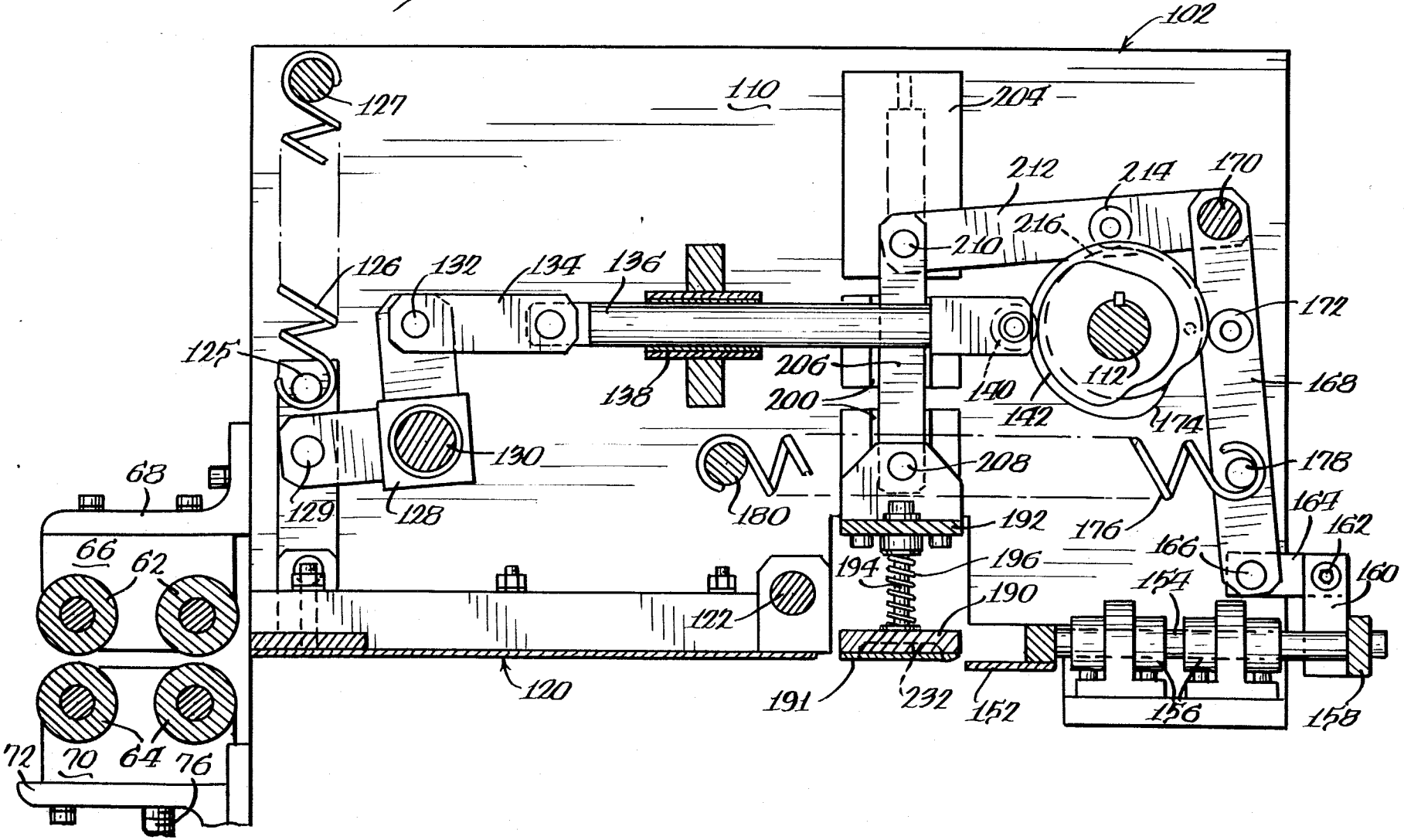
FIG. 7 is a cross-sectional view taken generally along lines 7—7 of FIG. 6.

The sensing mechanism is also preferably operated by the common camshaft 112, and includes a transversely extending movable foot pad 190 (see FIGS. 6, 7, and 8). The lower surface 191 of foot pad 190 is preferably provided with a suitable low-friction material, such as Teflon or the like, to minimize any damage to the sheets by contact with the movable foot pad. Foot pad 190 is preferably supported by a transversely extending foot pad carrier plate 192 by a plurality of shouldered support pins 194, with compression springs 196 held captive between plate 192 and foot pad 190 on the pins 194. This construction permits the foot pad 190 to move toward the carrier plate 192 in opposition to the biasing compression springs 196, but prevents the distance between the foot pad 190 and the carrier plate 192 from exceeding a predetermined value.

Cyclic operation of movable foot pad 190 in timed relation to operation of pusher mechanism 150 and pressure plate 120 is provided by a cam-actuated linkage associated with carrier plate 192. Vertically reciprocating movement of carrier plate 192 is provided by a pair of vertically extending guide rods 198 which extend upwardly from the carrier plate 192 through suitable slide bushings 200 or like linear bearings mounted on housing side plates 110. The guide rods 198 are adapted to move upwardly in opposition to biasing compression springs 202 held captive within spring holders 204 respectively mounted on housing side plates 110.

Upward movement of carrier plate 192 (and foot pad 190) in opposition to springs 196 is provided by a linkage including a link 206 pivotally connected to carrier plate 192 by a pin 208. Link 206 extends generally vertically, and is pivotally connected by a pin 210 to a follower link 212 pivotally supported on support shaft 170. A roller cam follower 214 is mounted on follower link 212 for following the profile of foot pad cam 216 affixed to camshaft 112. In this manner, cyclic operation of the sensing mechanism is provided in timed relation to pusher mechanism 150 and pressure plate 120.

In order to detect the position of the next sheet of the stack being unstacked after the previous sheet has been separated therefrom, the sensing mechanism includes a sensor probe 218 which is operatively associated with the movable foot pad mechanism. As best shown in FIGS. 5, 6, and 8, the vertically extending sensor probe 218 includes a shoulder 220 adapted to engage the upper surface of carrier plate 192, with the lower free end of probe 218 extending through foot pad 190 for contact with the sheets in the stack. A probe bracket 222 supports probe 218 on one of the housing side plates 110, with a biasing compression probe spring 224 held captive between bracket 222 and shoulder 220. A sensor probe finger 226 extends outwardly from probe 218 in order to trigger a photo-electric eye 228. Photo eye 228 is preferably suitably mounted on an adjustable support 230 to permit ready adjustment of the position of the photo eye relative to probe finger 226.

Before describing the sequence of cyclic operation of the present apparatus, several other preferred features of the device should be noted. As best illustrated in FIG. 8, movable foot pad 190 preferably includes an arrangement for creating a suction at the lower surface of the pad. The creation of a suction at this area facilitates the complete separation of a sheet from the remaining sheets of the stack by the air layer as the foot pad 190 is moved upwardly by its associated linkage. This arrangement is preferred since it facilitates high speed operation of the apparatus. The suction at this region is created by providing the foot pad 190 with one or more recessed areas 232 on its lower surface, with these recessed areas communicating with a suction creating venturi 234 mounted on the foot pad 190. The introduction of pressurized air through one end of venturi 234 thereby creates a suction at the lower surface of foot pad 190 to facilitate complete separation of a sheet from the remaining sheets of the stack for subsequent movement by pusher mechanism 150.

In order to initiate cyclic upward indexing elevation of stack-supporting platform 14 and the stack thereon, the automatic controls of the apparatus include a suitable cyclically operable switch device, such as proximity switch 240 (see FIG. 6). Switch 240 is mounted on housing 102 in close proximity to a suitable trigger, such as magnet 242, mounted on foot pad cam 216. As will be apparent, other suitable switching devices could alternately be employed.

To facilitate the required periodic replenishment of the apparatus with a new stack of sheet material, a light emitter 244 (see FIGS. 1 and 2) is arranged to cooperate with previously described photo eye 28 for signalling the controls of the apparatus when the lowermost sheet of a stack has been ejected therefrom. Emitter 224 and photo eye 28 further cooperate to signal the controls of the apparatus when a new stack of sheets has been received on platform 14, so that the platform and new stack are moved upwardly for destacking. In this regard, a photo-electric eye 246 and light emitter 248 are preferably provided (see FIGS. 1 and 2) for signalling the automatic controls of the apparatus to switch operation of the platform-elevating hydraulic actuator 46 from its high speed mode to its indexing mode.

Operation

A complete cycle of operation of the present destacker apparatus will now be described, including delivery of a stack of sheets to the apparatus, its sequence of cyclic operation during destacking of the sheets, and its operation for replenishing the apparatus with a new stack.

With stack-supporting platform 14 positioned in its lowermost position illustrated in FIGS. 1 and 2, a stack of sheets is received on rollers 20 from the associated roller conveyor 16 or the like. As the stack of sheets is received on rollers 20 of the platform, the light received by photo eye 28 from emitter 244 is blocked, signalling the automatic controls of the device to operate gate actuator 42 so that gates 30 are moved from their open to their closed position. The automatic controls then initiate upward elevation of the platform and stack, preferably by operation of the high speed circuit of the hydraulic fluid supply for hydraulic actuator 46. The entire stack is moved upwardly until the stack blocks the beam from light emitter 248 which is received by photo eye 246. Photo eye 246 then signals the automatic controls to switch from the high speed hydraulic circuit supplying fluid to actuator 46 to the low speed, stack indexing fluid supply circuit.

Figure 9:
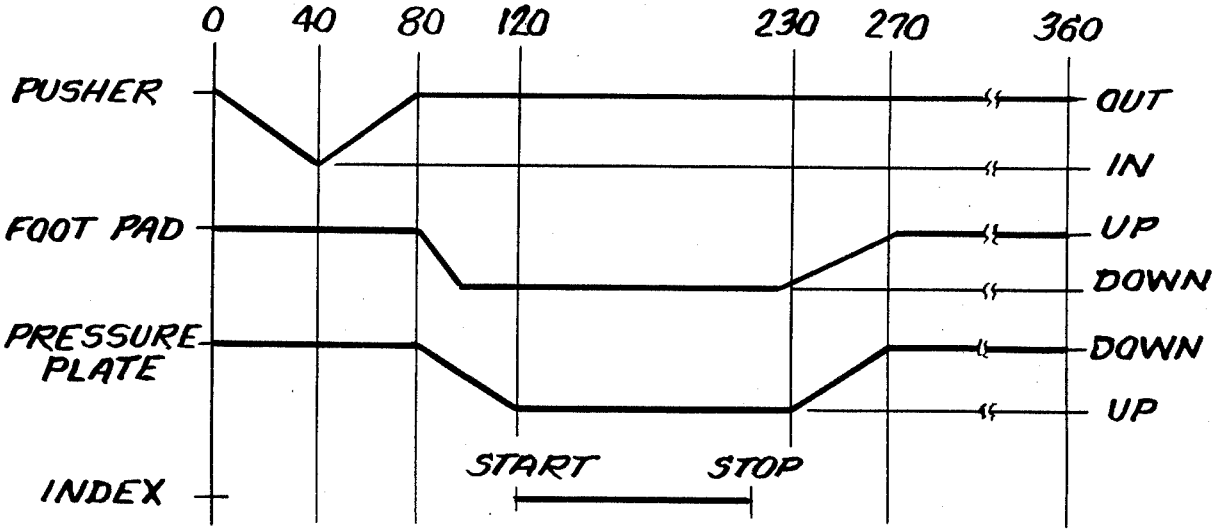
FIG. 9 is a chart illustrating the operational relationship of the various mechanisms of the present destacker apparatus.

Referring to FIG. 9, cyclic operation of the various mechanisms of the apparatus is graphically illustrated, with the curves illustrated generally representing the cam profiles of pressure plate cam 142, pusher cam 174, and foot pad cam 216. The horizontal axis of the graph represents time, and generally reflects one complete revolution of camshaft 112. The portion of FIG. 9 illustrating indexing operation of hydraulic actuator 46 reflects initiation of upward indexing by proximity switch 240, and stopping of upward indexing as signalled by photo eye 228 of the stack-sensing mechanism. FIGS. 10–13 diagramatically illustrate the operation of the apparatus during unstacking as the various mechanisms operate in timed relation with each other.

Figure 10:
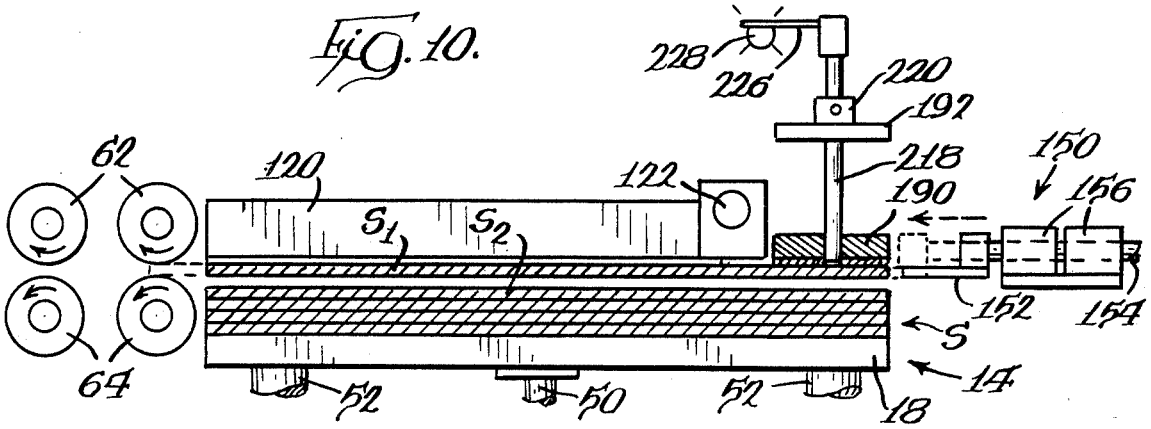
FIGS. 10–13 are diagrammatic views illustrating the operation of the present destacker apparatus.

When the stack of sheets on platform 14 has been positioned by the platform for unstacking, operation of roller mechanism 60, pressure plate 120, pusher mechanism 150, and movable foot pad 190 is initiated. Foot pad 190 is lowered by the operation of its associated linkage until it contacts the uppermost sheet of the stack. Upward indexing of the stack by hydraulic actuator 46 is subsequently initiated by the signal to the automatic controls from proximity switch 240. The stack is indexed upwardly until the uppermost one of the sheets reaches a predetermined location. As the stack is indexed upwardly, foot pad 190 is moved upwardly in opposition to springs 196 since carrier plate 192 remains stationary during stack indexing. Probe 218, which is in contact with the uppermost sheet of the stack, also moves upwardly until probe finger 226 blocks photo eye 228, which then signals the automatic controls to stop stack indexing. Continued rotation of camshaft 112 results in upward movement of carrier plate 192 which is moved upwardly a sufficient distance to extend springs 196, and lift foot pad 190 on shouldered support pins 194. The suction created on the lower surface of foot pad 190 assists with the separation of sheet $S_1$ from the remaining sheets of the stack on the layer of air created by air plenums 90. Sheet $S_1$ is now ready to be moved by pusher mechanism 150 as it floats on the air layer. FIG. 10 illustrates this step in the cyclic operation of the apparatus. It will be noted that pressure plate 120 is in its lowered position in order to limit the upward movement of the separated sheet $S_1$.

Figure 11:
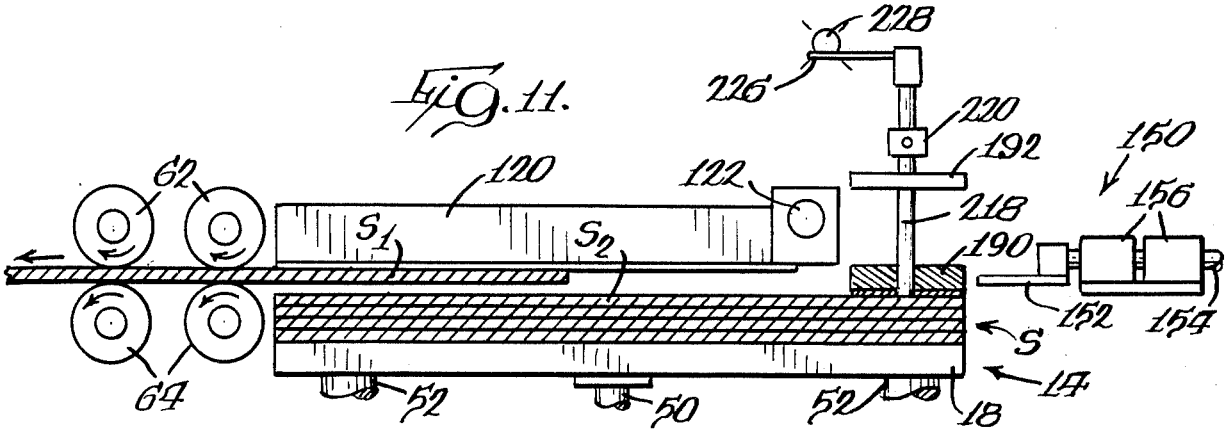

With further reference to FIGS. 9, 10, and 11, pusher mechanism 150 is next operated by its associated cam-actuated linkage so that pusher plate 152 engages the marginal edge of the separated sheet $S_1$ and advances the separated sheet into rollers 62 and 64. It will be noted that movable foot pad 192 has been retracted a sufficient distance to permit stroking of pusher plate 152 with clearance between the pusher plate and the foot pad.

Referring now to FIG. 11, initiation of the next cycle in the cyclic operation of the apparatus is illustrated. As separated plate $S_1$ is drawn through rollers 62 and 64, foot pad carrier plate 192 is lowered by its associated linkage so that foot pad 190 engages and is urged against the uppermost one of the remaining sheets of the stack, designated $S_2$. During this movement of carrier plate 192, probe 218 is lowered such that finger 226 moves from above photo eye 228 to a position below the photo eye. Pusher plate 152 remains in a retracted position so that clearance for movable foot pad 190 is provided.

Figure 12:
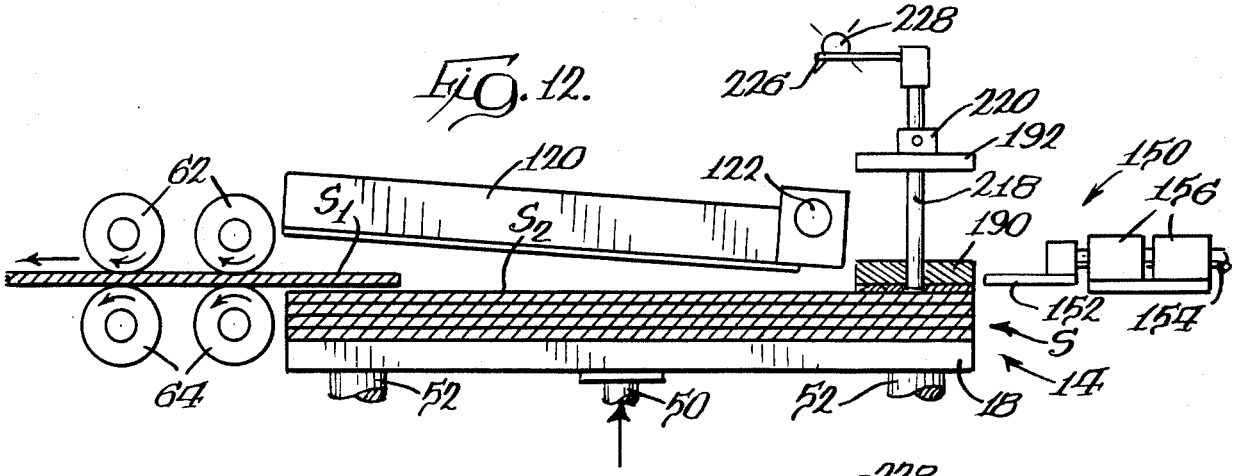

Referring now to FIG. 12, upward indexing of platform 14 and the stack of sheets is being effected by the stack elevating hydraulic actuator 46, with the signal provided to the automatic controls of the apparatus by proximity switch 240 initiating this function. As illustrated in FIG. 12 and shown graphically in FIG. 9, pressure plate 120 is preferably pivotally moved upwardly during the upward indexing of the stack of sheets. This desirably avoids any interference which might otherwise occur between the sheet $S_1$ which is being displaced by rollers 62 and 64, and the sheet $S_2$ which is being moved into relation to the air plenums 90 such that a layer of air is being formed under sheet $S_2$ and tending to separate it from the remaining sheets of the stack.

Figure 13:
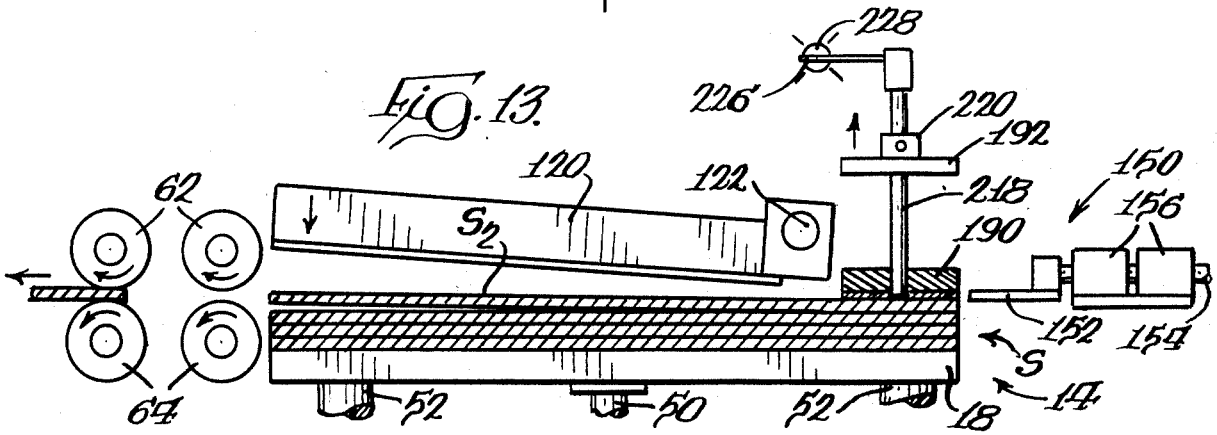

FIG. 13 illustrates the position of the various operating mechanisms when indexing of the stack of sheets is completed. The position of sheet $S_2$ is sensed by probe 218 to indicate the positioning of sheet $S_2$ at the predetermined location. Probe finger 226 passes in front-of photo eye 228, which in turn signals the automatic controls to stop upward indexing of the stack by hydraulic actuator 46. As will be appreciated, in this position of sheet $S_2$ at the predetermined location, air from plenums 90 directed against the stack tends to partially separate sheet $S_2$ before movable foot pad 190 is removed therefrom. As noted, the sensing mechanism, including probe 218, is thus sensing the position of sheet $S_2$ at a portion of the sheet which is maintained in contact with the remaining sheets of the stack to assure correct presentation of the sheet to the pusher mechanism 150.

As indicated by the arrows shown in FIG. 13, pressure plate 120 begins to move downwardly to its lowered position to limit the upward movement of sheet $S_2$. As indicated by the graph in FIG. 9, carrier plate 192 concurrently begins to move upwardly to permit the sheet $S_2$ to be fully separated by the layer of air being created by air plenums 90. During the upward movement of carrier plate 192, which results in upward movement of foot pad 190, the suction preferably created on the lower surface of foot pad 190 tends to draw the rearward portion of the sheet $S_2$ upwardly to enhance the speed with which a layer of air is created under sheet $S_2$ to completely float it above the remaining sheets. After pressure plate 120 has been moved downwardly, and carrier plate 192 has moved upwardly, the mechanisms would appear generally as illustrated in FIG. 10, with the sheet $S_2$ presented to the pusher mechanism 150 for movement out of registry with the remaining sheets of the stack by stroking of pusher plate 152.

As noted, the above-described arrangement for sensing the position of the uppermost one of the remaining sheets of the stack of sheets obviates problems which might otherwise occur if a fixed amount of indexing of the stack was provided during each cycle of the machine. As will be appreciated, the present apparatus could be made to function in a similar manner if the probe 218 were merely adapted to engage movable foot pad 190 (rather than extend through the foot pad), since the foot pad would engage the "solid" stack. However, the arrangement illustrated is preferred since any wear which takes place on the lower surface of foot pad 190 does not affect the desired timing of operation of the stack indexing mechanism.

The above sequence is cyclically repeated until each sheet of the stack is sequentially removed from the top thereof. When the lowermost sheet of the stack becomes the only sheet of the stack, air directed against the lower surface of the lowermost sheet through air passages 22 and air openings 24 defined by platform bed 18 assists with creating a layer of air beneath the lowermost sheet so that it is properly presented to the pusher mechanism 150. Direction of air against the lowermost sheet of the stack during its handling is preferred since the openings in the platform through which rollers 20 extend when the platform is in its lower, loading position inhibit creation of the desired layer of air beneath the lowermost sheet by air plenums 90.

When the lowermost sheet of the stack has been displaced by rollers 62 and 64, photo eye 28 again receives light from emitter 244, and thus signals the automatic controls of the apparatus to initiate lowering of platform 14 by operation of hydraulic actuator 46 by the high speed circuit of the fluid pressure supply. When the platform reaches its lowermost position, such as illustrated in FIGS. 1 and 2, downward movement of the platform is halted, with rollers 20 again protruding through the upper surface of platform bed 18. Gate actuator 42 is operated to open gates 30, with the rollers 20 then ready to receive a new stack of sheets from the associated roller conveyor 16.

From the foregoing description of the present destacker apparatus and its method of operation, it will be apparent that many modifications can be effected by those skilled in the art without departing from the teachings herein. For example, the various cam-actuated mechanisms of the apparatus could be otherwise operated although the illustrated embodiment provides operation of the mechanisms in the desired timed relation in a straightforward and reliable manner. Similarly, various ones of the photo-electric eyes and switching mechanisms associated with the automatic controls of the apparatus could be replaced with other similar components. Of significance, the illustrated embodiment of the apparatus has been found to operate with very high efficiency, being capable of destacking sheets of material, such as floor tiles, at speeds between 150 and 200 pieces per minute. At the same time, sliding contact between sheets of the stack is avoided, with minimal sliding contact taking place between the expansive surfaces of the sheets and the various mechanisms of the apparatus. In order to minimize any damage to the sheets by sliding contact with the mechanisms of the machine, the surfaces such as the lower surface of pressure plate 120, and the lower surface of movable foot pad 190, are preferably provided with a low friction material.

Thus, a unique destacker apparatus is disclosed which greatly facilitates efficient destacking of sheets of material from a stack of sheets. The apparatus is readily adaptable for handling sheets of various thicknesses, and in the preferred embodiment it is uniquely configured to accommodate slight variations in thicknesses which exist because of manufacturing tolerances. The present apparatus can be employed for unstacking sheets of many different materials, including plastic, wood, both ferrous and non-ferrous metals, glass, ceramic tile, cardboard, and any other sheet material which exhibits sufficient rigidity to be readily moved out of registry with the remaining sheets of the stack by engagement of the pusher mechanism 150 with the marginal edge portion of the sheet.

From the foregoing, it will be observed that numerous variations and modifications may be effected without departing from the true spirit and scope of the novel concept of the present invention. It will be understood that no limitation with respect to the specific apparatus illustrated herein is intended or should be inferred. It is, of course, intended to cover by the appended claims all such modifications as fall within the scope of the claims.

What is claimed is:

1. An apparatus for destacking sheets of material from a stack of such sheets, comprising:

means for directing air against said stack so as to cause at least one uppermost sheet to be separated from and floated above the remaining sheets of said stack;

means for moving said separated sheet comprising means for initially pushing said separated sheet out of registry with the remaining sheets by engagement with a marginal edge portion of said separated sheet, and roller means for subsequently displacing said separated sheet from above the remaining sheets of said stack after pushing of said separated sheet by said pushing means;

means for indexing the remaining sheets of said stack upwardly until the uppermost one of the remaining sheets reaches a predetermined location, said indexing means operating during displacement of said separated sheet from above the remaining sheets of said stack;

means for limiting upward movement of said separated sheet, and means apart from said indexing means for moving said limiting means upwardly during upward indexing of the remaining sheets of said stack; and means for sensing the position of the uppermost one of the remaining sheets before the uppermost remaining sheet is entirely separated from the sheet therebeneath by said air directing means.

2. The apparatus for destacking sheets of material according to claim 1, wherein said means for indexing includes means for elevating the remaining sheets of said stack, and means for controlling said elevating means, said control means comprising said sensing means, said sensing means being operable in timed relation to said pushing means for engaging the uppermost one of the remaining sheets of said stack after said pushing means pushes said separated sheet, said control means further comprising means for initiating elevation of said remaining sheets by said elevating means, said sensing means deactivating said elevating means when the uppermost one of said remaining sheets reaches said predetermined location.

3. An apparatus for destacking sheets of material from a stack of such sheets, comprising:

platform means for supporting said stack of sheets;

means for directing air against said stack so as to cause the uppermost sheet of said stack to be separated by a layer of air from the remaining sheets of said stack;

pusher means engageable with a marginal edge portion of said separated sheet for pushing said separated sheet out of registry with the remaining sheets of said stack;

roller means for receiving said separated sheet after pushing thereof by said pusher means, and for displacing said separated sheet from above the remaining sheets of said stack;

means for elevating said platform means until the uppermost one of said remaining sheets reaches a predetermined location, said elevating means operating during displacement of said separated sheet from above the remaining sheets of said stack; and means for sensing the position of the uppermost one of the remaining sheets of said stack, said sensing means being operatively associated with said elevating means to signal said elevating means to stop elevation of said platform means when said uppermost one of said remaining sheets reaches said predetermined location, said sensing means including vertically movable foot means, and means for moving said foot means in timed relation to said pusher means, said foot means being configured to engage the uppermost one of the remaining sheets after said separated sheet is moved by said pusher means, and to maintain the uppermost remaining sheet at least partially in contact with the sheet therebeneath as said air directing means directs air against said stack and tends to separate said uppermost remaining sheet from the sheet therebeneath, thereby sensing the position of the uppermost remaining sheet, said means for moving said foot means operating to move said foot means upwardly prior to operation of said pusher means.

4. The apparatus for destacking sheets of material according to claim 3, including means for limiting upward movement of said separated sheet, said limiting means being upwardly movable during elevation of said platform means by said elevating means.

5. The apparatus for destacking sheets of material according to claim 3, wherein said movable foot means includes suction means for moving the uppermost one of said remaining sheets upwardly after that one of the remaining sheets reaches said predetermined location.

6. The apparatus for destacking sheets of material according to claim 3, wherein said platform means includes means for directing air beneath the lowermost sheet of said remaining sheets of said stack when that lowermost sheet becomes the only remaining sheet of said stack and reaches said predetermined location by operation of said elevating means.

7. The apparatus for destacking sheets of material according to claim 3, including control means for operating said elevating means including means for detecting movement of the lowermost sheet of said stack from said platform means for operating said elevating means to lower said platform means to position said platform means to receive a further stack of sheets, and means for operating said elevating means to raise said platform and said further stack.

8. An apparatus for destacking sheets of material from a stack of such sheets, comprising:

a vertically movable platform adapted to carry said stack of sheets;

means for selectively upwardly indexing said platform;

air plenum means for directing air against opposite sides of said stack so that the uppermost sheet of said stack is entirely separated from and floated on a layer of air above the remaining sheets of said stack;

cyclically operable means for pushing said separated sheet out of registry with the remaining sheets of said stack;

means for limiting upward movement of said separated sheet, and means apart from said indexing means for moving said limiting means upwardly during upward indexing of said stack of sheets;

roller means for receiving said separated sheet after pushing thereof by said pushing means, and for displacing said separated sheet from above the remaining sheets of said stack, said indexing means operating during displacement of said separated sheet from above said remaining sheets;

sensing means for sensing the position of the uppermost one of the remaining sheets of said stack, said sensing means including cyclically operable vertically movable foot means adapted to engage the uppermost one of the remaining sheets of said stack and maintain that uppermost sheet at least partially in contact with the sheet beneath it as said air plenum means directs air against said stack and tends to separate said uppermost remaining sheet from the sheet therebeneath, to thereby sense the position of the uppermost remaining sheet, said foot means being operable in timed relation to said pushing means so that said foot means move downwardly into engagement with the uppermost one of the remaining sheets after said pushing means pushes said separated sheet; and means for signalling said indexing means to move said platform and said stack upwardly, said sensing means signalling said indexing means to stop upward movement of said platform and said stack when the uppermost one of said remaining sheets reaches a predetermined location;

said movable foot means being upwardly movable to permit said uppermost remaining sheet to be entirely separated from the sheet therebeneath by air directed against said stack by said air plenum means to permit pushing of the uppermost remaining sheet by said cyclically operable pushing means.

9. The apparatus for destacking sheets of material according to claim 8, wherein said pushing means, said movable foot means, and said movable limiting means are each movable by cam-actuated linkage means.

* * * * *